United States Patent [19]

Zima

[11] Patent Number: 4,655,409

[45] Date of Patent: Apr. 7, 1987

[54] PAPER SPOOL SUPPORT AND FEEDING MEANS

[76] Inventor: Lawrence M. Zima, 146 W. Bruceton Rd., Pittsburgh, Pa. 15236

[21] Appl. No.: 719,222

[22] Filed: Apr. 2, 1985

[51] Int. Cl.[4] ..... B65H 16/04; B65H 16/10; B41J 15/04; B41J 29/00

[52] U.S. Cl. ..... 242/55.2; 242/55.3; 242/67.1 R; 242/67.3 R

[58] Field of Search ..... 242/55.2, 67.1 R, 67.3 R, 242/55.3

[56] References Cited

U.S. PATENT DOCUMENTS

| | | | |
|---|---|---|---|
| 514,182 | 2/1894 | English et al. | 242/55.2 |
| 2,554,175 | 5/1951 | Duncan | 242/55.2 |
| 2,592,571 | 4/1952 | Huntington | 242/55.2 |
| 2,944,749 | 7/1960 | Maier | 242/55.2 |
| 3,067,963 | 12/1962 | Suggs | 242/55.2 |
| 3,338,531 | 8/1967 | Novotny | 242/67.3 R |
| 3,447,657 | 6/1969 | Majors | 242/67.1 R X |
| 4,065,068 | 12/1977 | Treadwell | 242/67.1 R |
| 4,151,039 | 4/1979 | Lash | 242/67.3 R X |
| 4,277,034 | 7/1981 | Buzzell | 242/67.3 R |

*Primary Examiner*—John Petrakes
*Attorney, Agent, or Firm*—Harry B. Keck

[57] ABSTRACT

A paper spool support and feeding device for use with a printer includes a support arm for retaining a paper spool and a paper feeding slit to restrict lateral movement of paper which is drawn from the spool. The device preferably is fabricated from rods, tubes or wires and preferably includes a flat mounting plate which can be positioned and frictionally retained beneath a printer.

12 Claims, 9 Drawing Figures

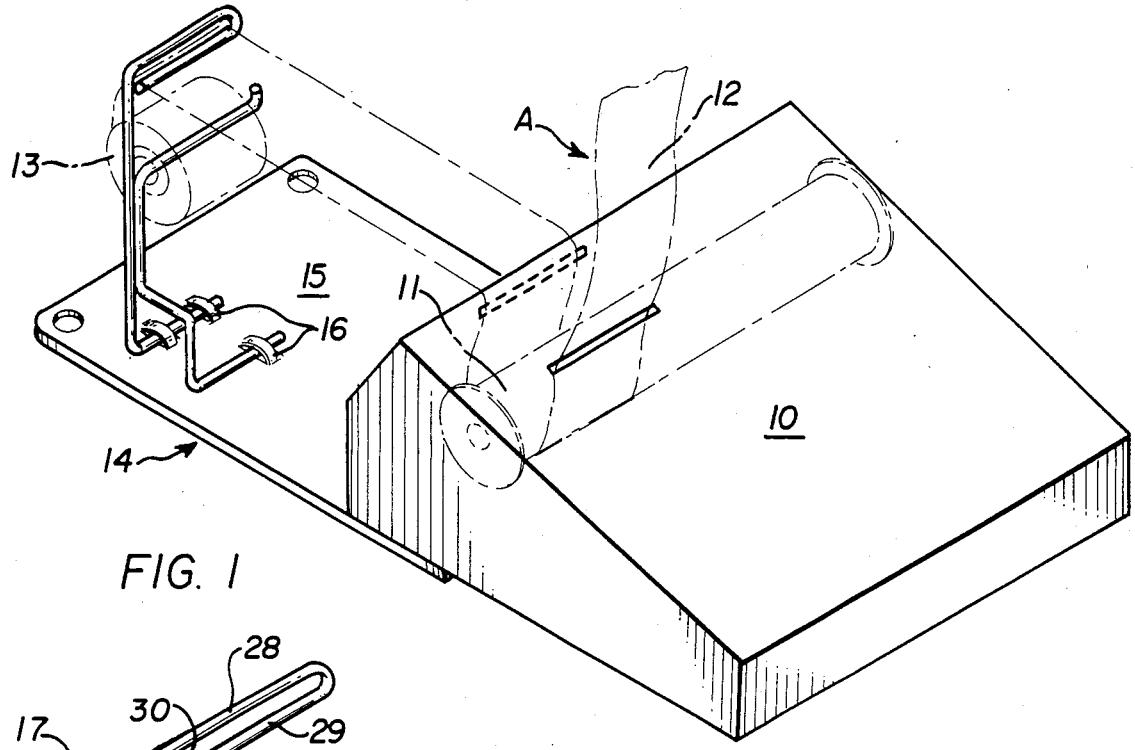
FIG. 1
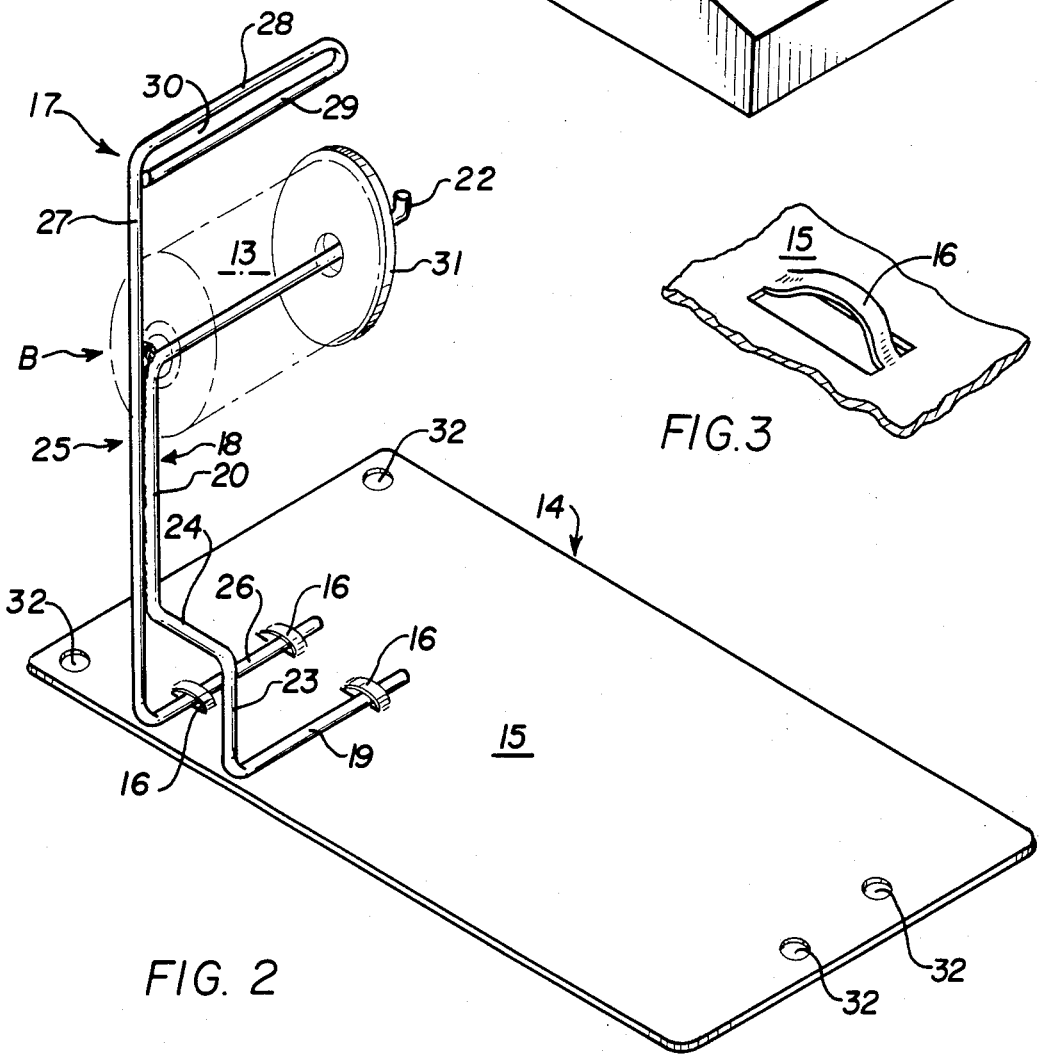
FIG. 2
FIG. 3

PAPER SPOOL SUPPORT AND FEEDING MEANS

BACKGROUND OF THE INVENTION

1. Field of the Invention

This invention relates to a paper spool support and feeding means, particularly adapted for use with a computer printer.

2. Description of the Prior Art

Many printers, driven by computers, have spools of paper which are unspooled and fed through the printer. Most such paper spools are mounted in a supporting and feeding device which maintains the axis of the paper spool generally parallel to the axis of the printer platen. The spools are relatively heavy and require substantial support means. The most commonplace paper spools have widths of 8 inches minimum up to about 17 inches maximum. Wider paper of course has been used to satisfy corresponding end-use printing requirements.

There is a need for feeding into such printers relatively narrow width strip paper, sometimes called cash register tape or adding machine tape. The strip paper in said spools is 2¼ inches or 3½ inches wide. One known device for feeding such cash register paper is expensive, bulky and includes complex mechanisms which regulate the feed speed of the cash register paper into the computer printers.

There is a particular need for a lightweight, low cost support and feeder for cash register paper to be used in computer-responsive printers. Typical applications arise in "point of sale" installations wherein the printer can create a "cash register receipt" for a purchaser and can introduce relevant sales information on standard size print paper at the same time. Programs to accomplish such objectives are in existence and require both regular size print paper (e.g., 8½ inches wide) and cash register paper (e.g., 2¼ or 3½ inches wide) to be fed to a common printer.

There is sometimes a further need for multiple copies of some cash register tapes. This feature is commonplace in point of sale cash registers wherein double wound paper is provided in a spool for the cash register. The cash register prints information on the first paper and, by pressure-sensitive inks embedded in the second paper, provides the identical information as a copy on the second paper strip which is respooled onto a second spool within the cash register. The original printed copy is delivered to the customer from the cash register by a sales clerk. There is a similar need to produce multiple copies of cash register transactions on cash register tape when a computer-responsive printer is employed as a point of sale combination accounting station and cash-register.

STATEMENT OF THE PRESENT INVENTION

The principal object of this invention is to provide a lightweight, low cost paper spool and feeding device for use with a computer-responsive printer. A further object of the invention is to provide a paper spool support and feeding device which can be supported by the weight of the printer itself and does not require special installation procedures or adapters. A still further object of the invention is to provide a paper support and feeding device for cash register tapes which restricts "tracking" of the paper across the width of the printer platen and also minimizes undesirable uncoiling of the spooled, unused cash register paper.

Yet a further object of this invention is to provide a paper spool support and feeding device which can be easily secured to a vertical surface if desired. Another object of the invention is to provide a lightweight, easily assembled, easily used paper spool support and feeding means for double-wound cash register paper which permits separate recovery and respooling of a second one of the cash register tapes.

These objectives are accomplished in a preferred embodiment by providing bent wires, rods or tubes which can be secured to a base plate at one end and which provide supporting structure for a paper spool at the other end and also provide an effective paper feeding slit at the other end. The base plate can be secured frictionally beneath the printer itself by the weight of the printer. Alternatively the base plate can be secured to a horizontal surface or to a vertical surface as dictated by the geometry of the printer or the particular desires of the printer operator.

DESCRIPTION OF THE DRAWINGS

FIG. 1 is a schematic illustration of a printer with a paper spool support and feeding device according to the present invention.

FIG. 2 is a perspective view of the preferred embodiment of the paper spool support and feeding device of this invention.

FIG. 3 is a fragmentary sketch of a base plate showing punch-up hasps.

DESCRIPTION OF THE PREFERRED EMBODIMENTS

Figure 4:
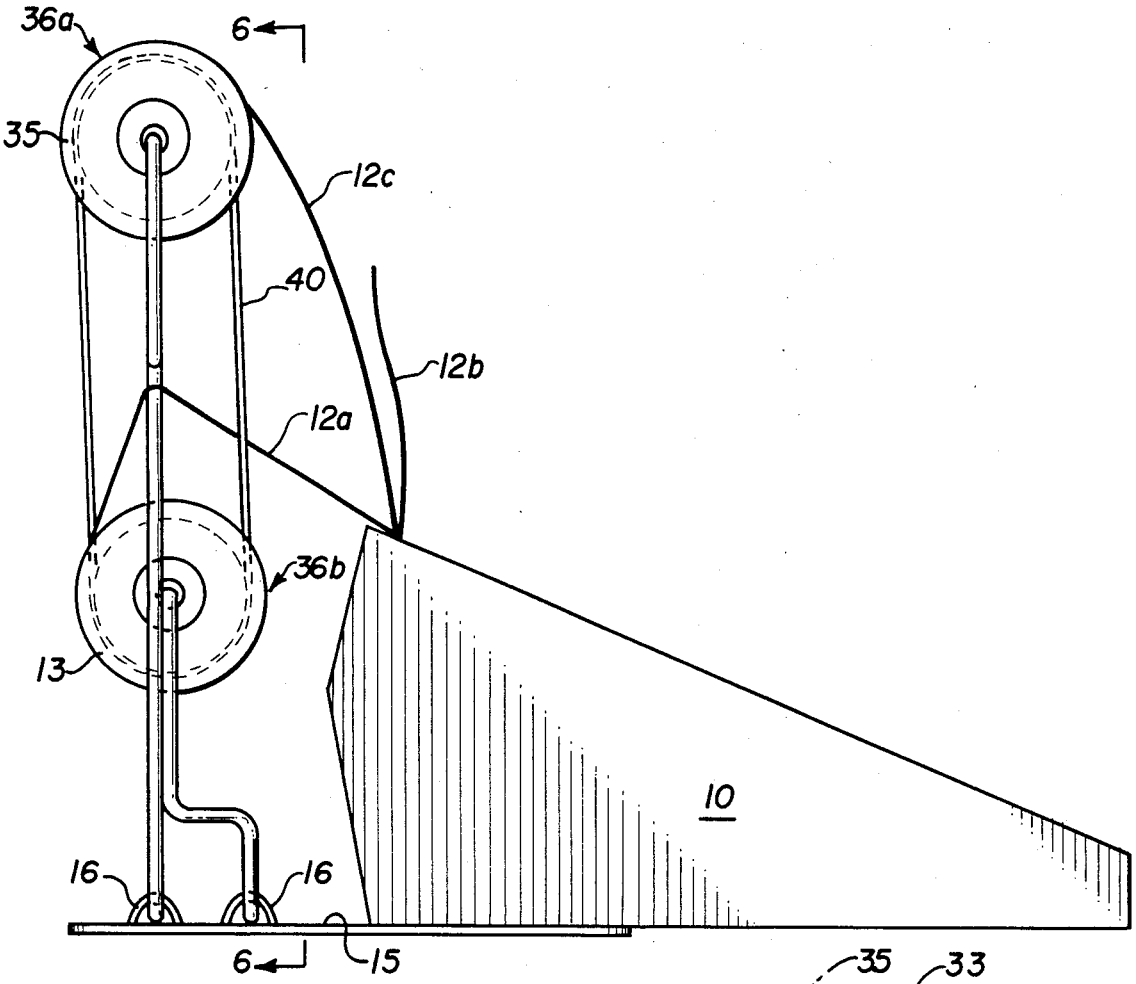
FIG. 4 is a side illustration showing an installation for recovering a printed copy of the cash register tape from a printer.

In FIG. 1, a computer-responsive printer 10 includes a printing platen 11 which receives prints and delivers a strip of cash register paper 12. A spool 13 of cash register paper is mounted adjacent to the printer 10 on a paper spool support and feeding device 14. In a preferred embodiment, the device 14 includes a base plate 15 which is preferably a sheet of steel about 4 to 10 inches wide and 6 to 12 inches long and having a thickness of about 20 to about 16 gauge. The base plate 15 has several punch-up hasps 16 and more fully illustrated in FIG. 3 which provide tunnels for receiving wires, rods or tubes.

A wire or rod assembly 17 is formed from two wires secured together along contiguous portions B (FIG. 2). A first wire 18 includes a horizontal base 19, an intermediate vertical portion 20, a horizontal core holding arm 21 having an upwardly bent terminal edge 22. A vertical leg 23 and horizontal leg 24, as shown, connect the horizontal base 19 with the intermediate vertical portion 20. A single inclined or arcuate element, not shown, can connect the vertical portion 20 with the horizontal base 19. A second wire 25 has a generally horizontal base 26, an intermediate vertical portion 27, a horizontal arm 28 which is bent at its remote end and a second horizontal arm 29. A paper-receiving slit 30 is defined between the horizontal arm 28 and the second horizontal arm 29.

The two horizontal bases 19, 26 are rigidly secured to the base plate 15 by engagement beneath at least three hasps 16.

The two wires or rods preferably steel wire having a diameter of about 1/16 to ¼ inch, preferably about ⅛ inch.

The paper spool support and feeding device 14 is secured adjacent to the printer 10 preferably by placing the base plate 15 beneath a supporting leg (not shown) of the printer 10. In the operative position, the horizontal arms 21, 28, 29 are parallel to each other and also parallel to the axis of the printer platen 11.

A spool 13 of cash register paper normally is about 2¼ or 3½ inches wide. The free end of the paper strip is uncoiled from the spool 13 and introduced into the slit 30 where it experiences a direction change and thereupon enters into the printer 10 where it passes around the platen 11. Following printing operations, the paper strip is recovered as a free end at A (FIG. 1). The slit 30 restricts lateral movement (sometimes referred to as "tracking") of the cash register paper 12 and maintains an intended alignment of the cash register paper 12 relative to the printer platen 11. The horizontal arm 29 defines a direction change for the cash register paper 12 and thereby restricts the amount of tension applied to the spool 13 in normal operations, thereby retarding some unwanted paper uncoiling from the spool 13.

A circular disk 31 having a central aperture may be applied to the horizontal arm 21 to enclose the open end of the spool 13. The upwardly bent terminal edge 22 of the horizontal arm 21 will retain the circular disk 31 and prevent significant movement of the spool 13.

A number of fastener-receiving apertures 32 are provided in the base plate 15 to permit permanent fastening of the base plate 15 to a horizontal or vertical surface. It should be observed that the preferred embodiment of FIG. 1 shows the base plate 15 horizontally positioned beneath the printer 10. It should be apparent that the base plate 15 may also be secured to a vertical wall in proximity to the printer 10. The device permits quick and simple replacement of a cash register tape spool when required. The cash register tape 12 can be withdrawn from the printer and respooled in those instances where there is no need for the cash register paper printout from the printer 10.

It will be observed that the vertical portion 20 of the first wire 18 and the vertical portion 27 are parallel and contiguous in the region B (FIG. 2). The two wires 18, 25 are secured together by welding, by adhesives or by other connections along some contiguous portion so that the paper spool support and feeding device 14 has a fixed three-dimensional character to accommodate a rigid mounting. The secured wires 18, 25 constitute a stanchion to support the first horizontal arm 21 and the second horizontal arm 28.

Figure 5:
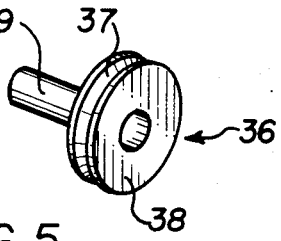
FIG. 5 is a perspective illustration of a press-fit insert pulley for re-use with cash register spools in the embodiment of the invention illustrated in FIG. 4.
Figure 6:
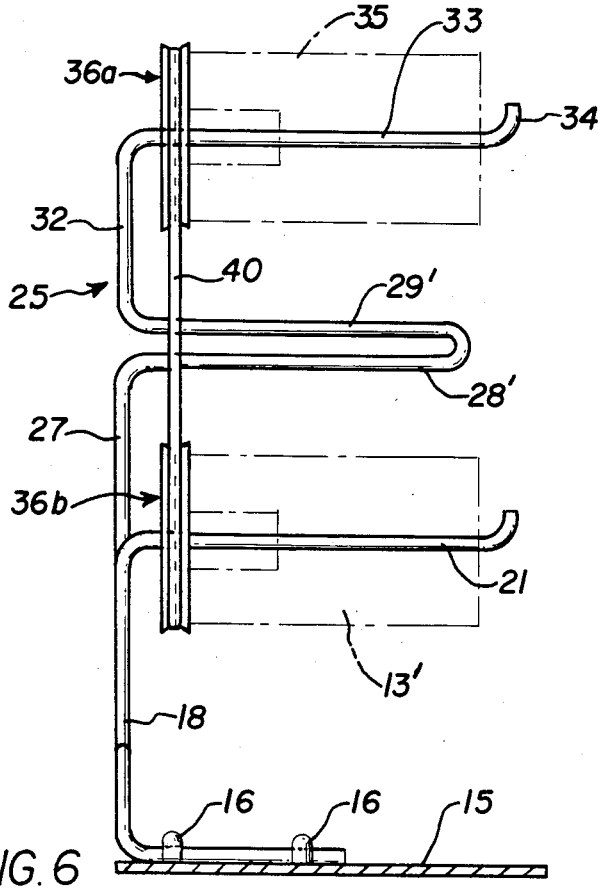
FIG. 6 is a front view of the installation of FIG. 4 taken along the line 6—6.

A further embodiment of the invention is illustrated in FIGS. 4, 5, 6 wherein two spool supporting arms are provided to accommodate a double cash register tape requirement. The first wire element 18 of FIG. 6 is unchanged. The second wire element includes an intermediate vertical portion 27, a horizontal arm 28′ and a second horizontal arm 29′ which is above the first horizontal arm 28′. The second wire element also includes a second intermediate vertical portion 32 and a third horizontal arm 33 terminating in an upwardly bent terminal edge 34. In operation, a spool 13′ of double-wound cash register tape is mounted on the horizontal arm 21 as in the embodiment of FIGS. 1, 2. A recoiling spool 35 is mounted on the third horizontal arm 33.

Double-wound paper 12*a* is withdrawn from the spool 13′ into the printer 10. After the printing operation is completed, one of the paper sheets 12*b* is separately withdrawn and torn into as many units as required. The second paper sheet 12*c* is recoiled on the recoiling spool 35.

A simple means for providing the recoil spool drive is illustrated in FIGS. 4, 5, 6. A press-fit pulley 36 comprising a disk 38 having a peripheral groove 37 is secured to a rod or hollow tube 39. The rod or hollow tube 39 is inserted and press-fitted into the core of a cash register paper spool before the spool is applied to the horizontal arms 21, 33. A rubber band is set into the prepared grooves of the two pulleys 36*a*, 36*b* to serve as an inexpensive driving belt. The rubber band 40 may be twisted to reverse the rotation of the recoiling spool 35 if required.

Figure 7:
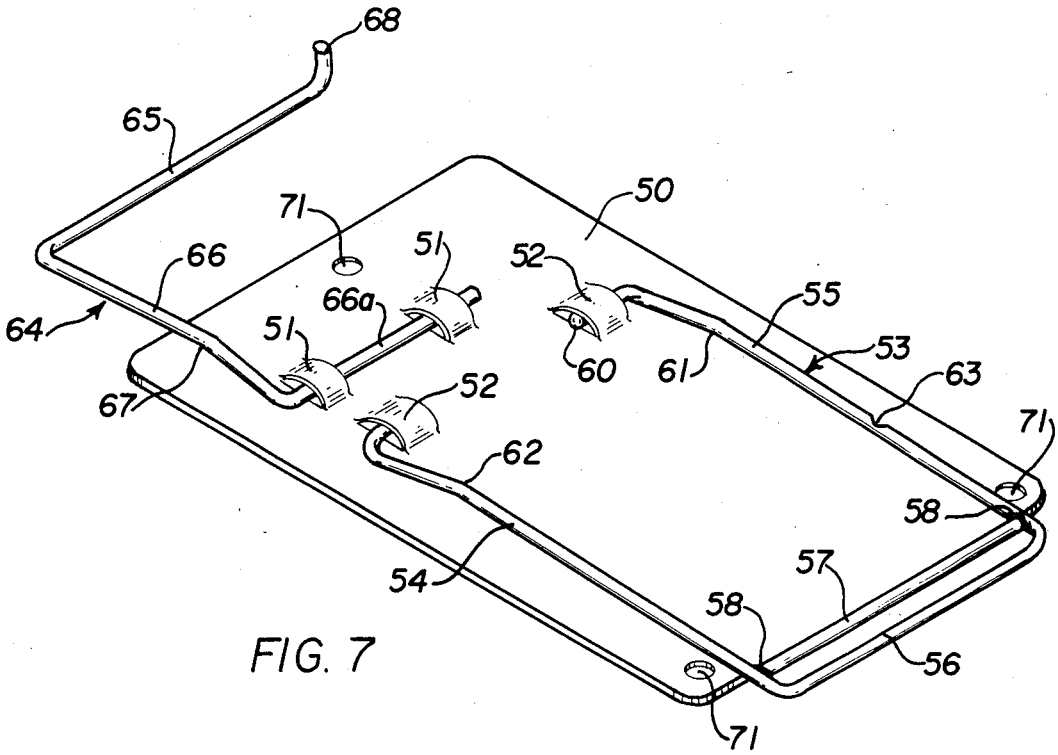
FIG. 7 is a perspective illustration of an alternative embodiment of the present invention shown in a disassembled form for shipment or storage.
Figure 8:
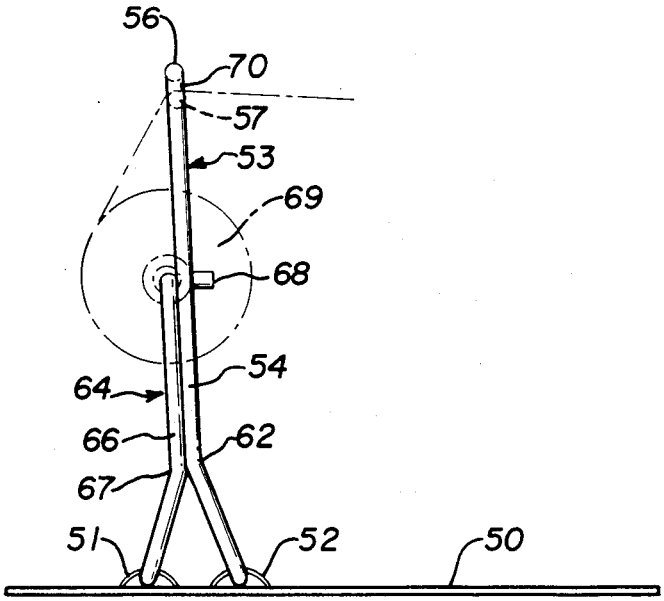
FIG. 8 is a side elevation of the apparatus of FIG. 7 in its operating condition.
Figure 9:
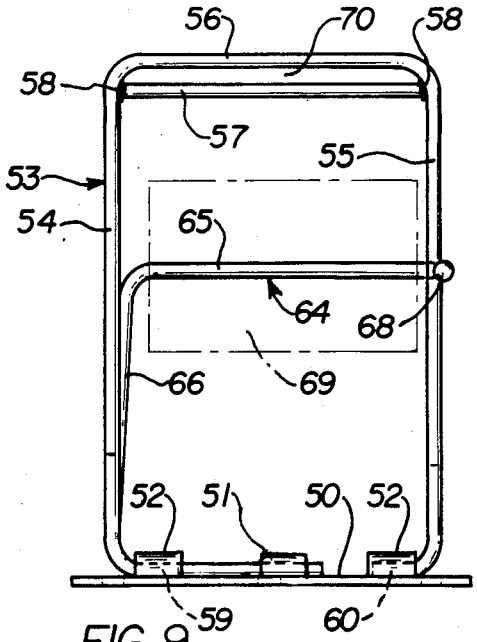
FIG. 9 is a front elevation of the apparatus of FIG. 8.

An alternative embodiment of the present invention is illustrated in FIGS. 7, 8, 9 wherein a base plate 50 is provided with punch-up tunnels 51, 52 which are adapted to receive an end of a wire or rod. A first generally U-shaped rod member 53 is provided with generally parallel side members 54, 55 and a base 56 which is perpendicular to the side members 54, 55. A bar member 57 is connected generally parallel to the base 56 to the side members 54, 55 by means of spot welds 58 or other connections. The open ends of the side members 54, 55 are joined to perpendicularly extending tips 59, 60 which are engaged beneath tunnels 52. The side members 54, 55 have intermediate bend 61, 62. The side member 55 also has a notch 63.

A second rod member 64 has a generally horizontal spool support arm 65 which extends perpendicularly from a side element 66 containing an intermediate bend 67. The base of the side element 66 is connected to a tip 66*a* which is engaged pivotally beneath a tunnel 51. The extremity of the spool support arm 65 contains a bent tip 68.

As shown in FIG. 7, the rod elements 53, 64 are flattened against the base plate 54, for compact shipping or storage.

When the apparatus is in use, the rod elements 53, 64 are rotated into engagement as shown in FIGS. 8, 9. A spool 69 of cash register paper is placed on the spool support arm 65 and the tip 68 engages the notch 63 as seen particularly in FIG. 9. The two rod elements 53, 64 form a rigid structure. A paper slit 70 is provided between the base 56 and the rod 57. In all other respects the device of FIGS. 7, 8, 9 functions in the manner of the device illustrated in FIGS. 1 and 2. Fastener receiving openings 71 permit the device to be secured to a horizontal or vertical surface as desired.

I claim:

1. In combination, a paper spool support and feeding means and a printer comprising:

a base sheet;

a first wire member having a mounting element, a stanchion at right angles to said mounting element, a first horizontal arm perpendicular to said stanchion terminating in a re-entrant elbow and communicating with a second arm, parallel to the said first horizontal arm and spaced-apart therefrom whereby the said first and second horizontal arms present a slit adapted to receive a strip of paper; a second wire member having a mounting element, a first connecting element perpendicular to said mounting element and connected to the said stanchion; a support arm extending perpendicular from the upper end of said connecting element generally parallel to said first horizontal arm;

said mounting elements being secured to said base sheet.

2. The combination of claim 1 wherein the said base sheet has punched-up hasp elements for receiving said mounting elements and rigidly securing said first and second wire members.

3. The combination of claim 1 wherein said base sheet is a rectangular base plate having aligned punch-up hasps for receiving mounting elements;

said mounting element of said first wire member is adapted to fit under at least one of said hasps, and said mounting element of said second wire member is adapted to be engaged in at least one of said hasps.

4. The combination of claim 1 including a second support arm which is generally parallel to the first said support arm, a first spool of paper mounted on said first support arm, said second support arm being adapted to extend through a core of a second spool of paper.

5. The combination of claim 4 wherein the said first spool of paper is double wound.

6. In combination, a paper spool support and feeding means and a printer including:

a U-shaped member having generally parllel side members extending perpendicularly from a base, said U-shaped member being secured at its open ends to a mounting element; a transverse rod generally parallel to said base and secured to the said side members to define a paper slit between said transverse rod and said base;

a second member having a generally horizontal support arm connected perpendicularly to a side element, means for mounting said side element to said mounting means;

means for engaging said U-shaped member and said second member to form a rigid device which is adapted to receive a spool of paper on said support arm between said side members.

7. The paper spool support and feeding means of claim 6 wherein said mounting element is a generally flat plate, and wherein the said U-shaped member has extensions at the open ends of said side members which are secured to said flat plate, and wherein said side element of said second member extends perpendicularly from said flat plate.

8. The paper spool support and feeding means of claim 7 wherein the said U-shaped member and said second member are pivoted about parallel axes adjacent to the said flat plate to permit nesting of the said U-shaped member and second member against said flat plate to form a relatively flat structure for shipping or storage.

9. The combination of claim 7 wherein the said flat plate is a sheet having punched-up hasp elements for receiving said mounting elements.

10. The combination of claim 7 wherein said flat plate includes means to secure said flat base to a vertical wall surface.

11. The combination of claim 6 wherein the said paper slit changes direction of the said paper between the said spool and the said printer.

12. The combination of claim 6 wherein the said U-shaped member and the said second member are formed from wires, rods or tubes.

* * * * *